US009443671B2

(12) United States Patent
Goodwin et al.

(10) Patent No.: US 9,443,671 B2
(45) Date of Patent: Sep. 13, 2016

(54) APPARATUS AND METHOD TO PASS ELECTRICAL SIGNALS THROUGH A REFRIGERATOR CABINET LINER

(71) Applicant: Whirlpool Corporation, Benton Harbor, MI (US)

(72) Inventors: Kirk W. Goodwin, St. Joseph, MI (US); Duane M. Kobos, LaPorte, IN (US); Michael Todd Moore, Paw Paw, MI (US); Karen J. Querfurth, Coloam, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 60 days.

(21) Appl. No.: 14/493,431

(22) Filed: Sep. 23, 2014

(65) Prior Publication Data

US 2016/0086747 A1 Mar. 24, 2016

(51) Int. Cl.
*H01H 3/16* (2006.01)
*H01H 13/14* (2006.01)

(52) U.S. Cl.
CPC ..... *H01H 13/14* (2013.01); *H01H 2231/012* (2013.01)

(58) Field of Classification Search
CPC ..... H01R 13/74; F25D 2400/40
USPC ..... 200/61.62, 61.81; 312/401, 404; 362/94
See application file for complete search history.

(56) References Cited

U.S. PATENT DOCUMENTS

| | | | | |
|---|---|---|---|---|
| 3,506,325 | A * | 4/1970 | Horvay | F25D 25/02 312/223.5 |
| 5,238,299 | A * | 8/1993 | McKinney | F25D 23/065 174/153 G |
| 5,772,469 | A * | 6/1998 | Polgar | H01R 13/74 439/546 |
| 5,888,093 | A * | 3/1999 | Polgar | H01R 13/74 439/248 |
| 6,150,622 | A * | 11/2000 | Malnati | F25D 29/005 200/61.62 |
| 7,357,669 | B2 * | 4/2008 | Gabet | H01R 4/64 439/549 |
| 8,112,865 | B2 * | 2/2012 | Jang | F25D 23/065 29/433 |
| 2011/0234074 | A1 * | 9/2011 | Dolinsek | F25D 23/028 312/404 |

* cited by examiner

*Primary Examiner* — Vanessa Girardi

(57) ABSTRACT

An apparatus to pass an electrical signal within a refrigerator having a liner partially defining an interior compartment and having an opening, and a moveable member, includes first and second members not passable through the opening when the apparatus is at a first rotational orientation, at least one of the first and second members passable through the opening when the apparatus is at a second rotational orientation, a planar third member between the first and second members fitting in the opening at the first rotational orientation, an electrically conductive contact to conduct the electrical signal to the moveable member when the moveable member is at a predetermined position relative to the apparatus, and a electrical conductor electrically coupled to the contact and passing through the apparatus to conduct the electrical signal from the exterior of the liner to the contact.

20 Claims, 9 Drawing Sheets

APPARATUS AND METHOD TO PASS ELECTRICAL SIGNALS THROUGH A REFRIGERATOR CABINET LINER

FIELD OF THE DISCLOSURE

This disclosure relates generally to refrigerators, and, more particularly, to refrigerators, methods and apparatus to pass electrical signals through refrigerator liners.

BACKGROUND

Many appliances include lighting to assist in the viewing of items present, placed or stored in an appliance.

SUMMARY

Example refrigerators, methods and apparatus to pass electrical signals through refrigerator liners are disclosed. An example apparatus to pass an electrical signal within a refrigerator having an external cabinet, a liner at least partially defining an interior compartment within the cabinet and having an opening defined therethrough, and a moveable member within the compartment, includes first and second members not passable through the opening when the apparatus is positioned at a first rotational orientation, where at least one of the first and second members is passable through the opening when the apparatus is positioned at a second rotational orientation; a planar third member between the first and second members, and dimensioned and shaped corresponding to the opening and fitting in the opening when the apparatus is positioned at the first rotational orientation; an electrically conductive contact disposed together with the first member or a fourth member extending inward from the first member to conduct the electrical signal to the moveable member when the moveable member is at a predetermined position relative to the apparatus; and a electrical conductor electrically coupled to the contact and passing through the first, second and third members to the exterior of the liner to conduct the electrical signal from the exterior of the liner to the contact.

An example refrigerator includes a cabinet, a liner at least partially defining an interior compartment within the cabinet, a liner pass through partially passing through and assembled to the liner, the liner pass through including a first electrically conductive contact within the compartment and a second electrically conductive contact outside the compartment, a selectively moveable member having an electronic component, and a third electrically conductive contact to electrically couple the electronic component to the first contact, and a spring member to bias the first and third contacts into electrical coupling when the moveable member is at a predetermined position

BRIEF DESCRIPTION OF THE DRAWINGS

FIGS. 10A-B illustrate an example insertion of a shelf into a refrigerator to electrically couple the shelf to a liner pass through.

DETAILED DESCRIPTION

Figure 1:
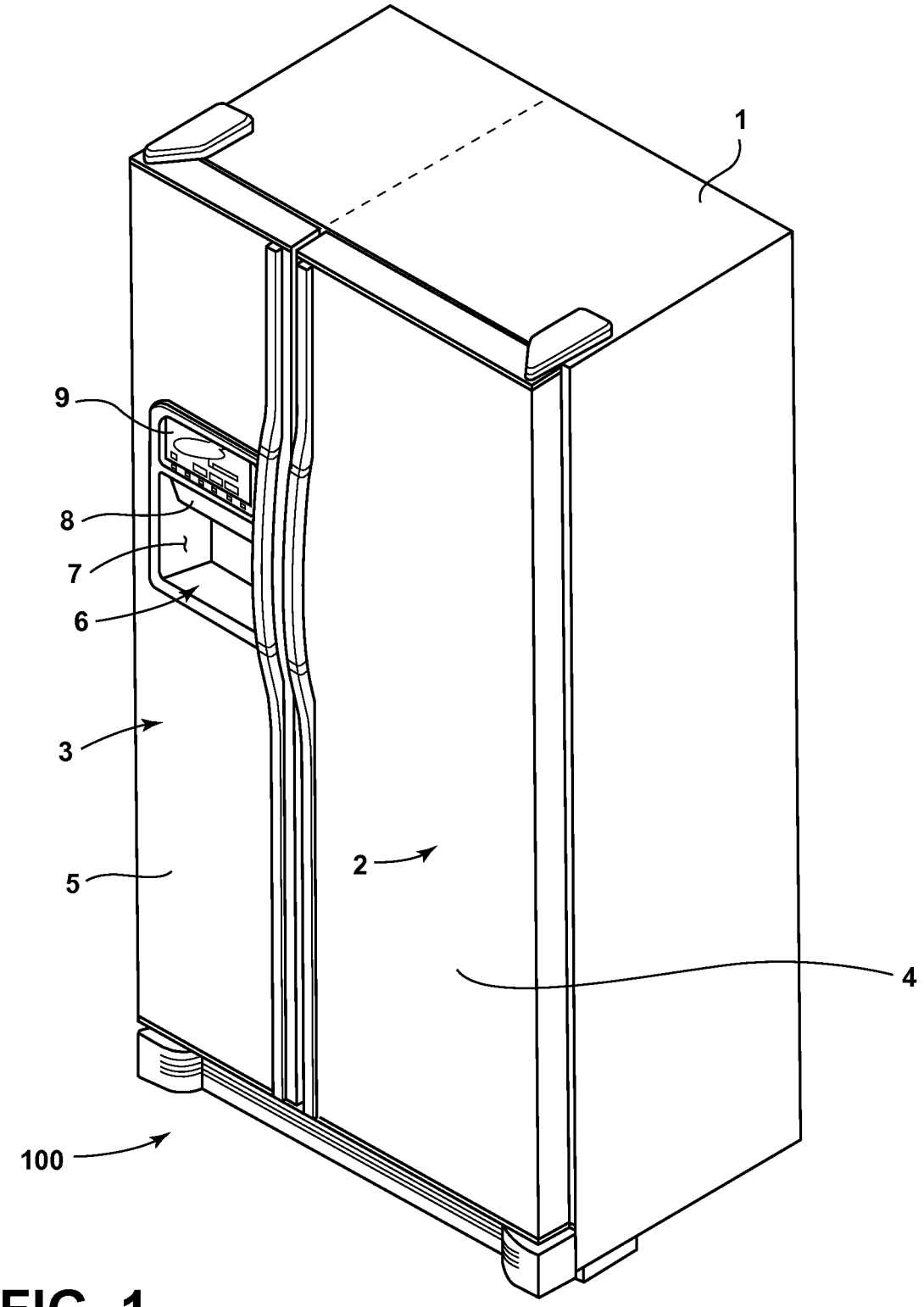
FIG. 1 is an isometric perspective view of an example refrigerator.

For ease of discussion, the examples disclosed herein are described in the context of a refrigerating compartment of a refrigerator. It should be understood that the examples disclosed herein are also applicable to a freezing compartment of a refrigerator, an icemaker, a wine cooler or refrigerator, a freezer, etc. Moreover, the examples disclosed herein may be used in connection with any other appliance, structure or device including, but not limited to, a washing machine, a dryer, a stove, a microwave, a dishwasher, a refresher, a cabinet, a storage unit, a shelf, a closet, a wall, or any other structure, device or appliance having a surface, a liner, a wall, or any other member or structure through which conducting an electrical signal is desired and/or needed.

As used herein, a refrigerator liner defines an interior or user accessible compartment or cavity within a refrigerator into which items may be placed for refrigeration. Further, the inside or interior side of the liner refers to the side of the liner facing the interior compartment; and the outside or exterior side of the liner refers to the side of the liner opposite the interior compartment and is typically exposed to components of the refrigerator generally not intended for user access or exposure to a user. Further still, inward refers to a direction generally toward the interior compartment or generally toward a middle of the interior compartment. In some refrigerators, rigid foam, insulating material, structural material, etc. is formed between the outside of the liner and a metal exterior housing or cabinet of the refrigerator, with wires and/or tubing encompassed by, or routed within or through such material(s). A refrigerator liner may be formed of one or more pieces, which are typically plastic.

As used herein, electrical coupling (or variants thereof) refers to the connecting of, for example, two devices so that an electrical signal may be conducted, conveyed, transported, passed or otherwise moved between the two devices. Electrical signals include an electric current, an electromagnetic field, etc.; may be constant and/or varying; and may be conducted over a physical conductor (e.g., a wire) and/or wirelessly. Despite the above, persons of ordinary skill in the art readily understand what an electrical signal is, and what is electrical coupling. Electrical signals may be used to provide for example, a power source, a communication signal, a user interface signal, a sensor signal, etc. to an electronic component. However, for ease of discussion, the examples disclosed herein will be described with reference to passing a power signal through a refrigerator liner.

Lighting in a refrigerator can radiate from, for example, bulbs or light emitting diodes (LEDs), which may be combined with covers or lenses. The light sources can be placed at different locations within the interior compartment of a refrigerator. For example, liner-dwelling light sources may be placed in a ceiling liner, a left-side wall liner wall and/or a right-side wall liner. Additional example locations of light sources include surfaces or structures that result in illumination beneath shelves or inside crisper drawers, pantry drawers, bins, baskets, etc. However, for ease of discussion, the examples disclosed herein will be described with reference to light sources associated with shelves.

While the liner-located sources project light into the refrigerator interior, they may also project light toward the consumer, which may result in observable bright spots. In some examples, a limited number of liner-dwelling illumination sources are used to reduce costs. The result is that overall interior illumination may be uneven. An example solution is to place light sources under shelves, where the light sources and bright spots can more easily be hidden from view. Additionally, more evenly distributed light intensity may be obtained by placing a greater number of relatively low-power light sources under a shelf. By way of example, this more even light intensity may be obtained using one or more printed circuit board (PCB) strips onto which are mounted multiple LEDs.

It is understood that the routing of power to light sources placed under a shelf requires electrical conductors or power paths from an electrical power supply to the shelf. These power supplies are typically located outside of the interior compartment. Some prior solutions use the electrical conductivity of shelf mounting hardware, also known as ladders or standards, and removable shelf brackets, to provide power to a shelf. However, such solutions are not applicable to refrigerators that do not have electrically conductive standards and brackets. For example, some refrigerators have shelves that rest on non-conductive plastic studs or ribs that protrude inward. The non-conductive studs or ribs do not provide a power routing path. Alternate power routing solutions include plugs and sockets, which require slack lengths of cable(s) and fine-motor human skills to mate connectors, and as such may not be desirable to users or robust to cable damage and bent conductors. Further, the small conductor surfaces and small mating connection spaces in such solutions may, for example, become contaminated by inadvertent food contact.

It is further understood that shelves in a refrigerator are typically removable for cleaning and/or repositionable for storage of varied height items that reside on the shelves. Other example moveable members include drawers, crispers, bins, baskets, etc. Additionally, the dimensions between left and right side liner walls, and the planar flatness of liner surfaces may vary due to manufacturing processes, temperature-induced expansion and contraction, etc.

Example refrigerators, methods and apparatus to provide electrical signals through refrigerator liners that overcome at least these problems are disclosed. The disclosed example refrigerators, methods and apparatus allow for the selective interruption of electrical signal conduction while facilitating easy shelf removal, shelf installation, and shelf repositioning. The disclosed examples are robust to inadvertent food contact, to environmental corrosion, to temperature effects, to repeated cycles of removal and installation, etc. Further, the disclosed examples accommodate dimensional and/or flatness variations.

This disclosure provides examples of routing electrical signals from outside a liner to electronic devices or components placed on, within, near, or under a moveable member within an interior compartment. Moreover, the examples disclosed herein can be used to pass electrical signals to any number of electrical components or devices, examples of which are lighting units, sensors, resistance heaters, thermoelectric devices, displays, annunciators, control circuitry, etc. Additionally or alternatively, the refrigerators, methods and apparatus disclosed herein may be used to pass any number and/or type(s) of other electrical signals between a signal source and a device that could, for example, utilize the signal, modify the signal, and/or return a signal. Example signals include a varied current signal, a varied voltage level signal, signals having different frequencies, etc. That is, the examples disclosed herein may be used to pass any number and/or type(s) of electrical signals through a refrigerator liner between any number, type(s) and/or combination(s) of electronic components.

Reference will now be made in detail to embodiments of this disclosure, examples of which are illustrated in the accompanying drawings. The embodiments are described below by referring to the drawings, wherein like reference numerals refer to like elements. Here, configurations of an example refrigerator according to this disclosure will be described with reference to FIG. 1. While the examples disclosed herein are described and illustrated with reference to a side-by-side refrigerator, those of ordinary skill in the art will recognize that the examples disclosed herein may be implemented in any other refrigerator configuration.

Figure 2C:
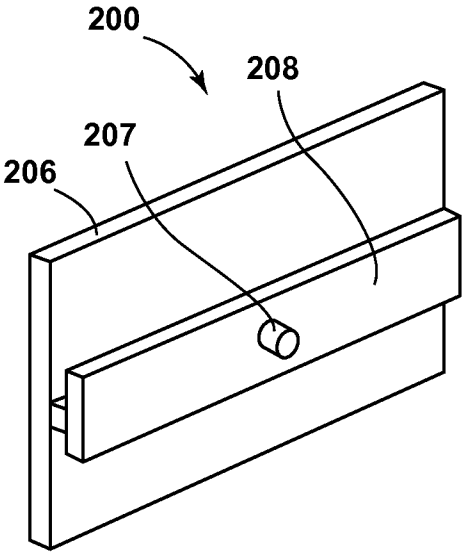
FIGS. 2A-C are, respectively, side, front isometric perspective, and rear isometric perspective views of an example liner pass through constructed in accordance with the teachings of this disclosure.
Figure 2B:
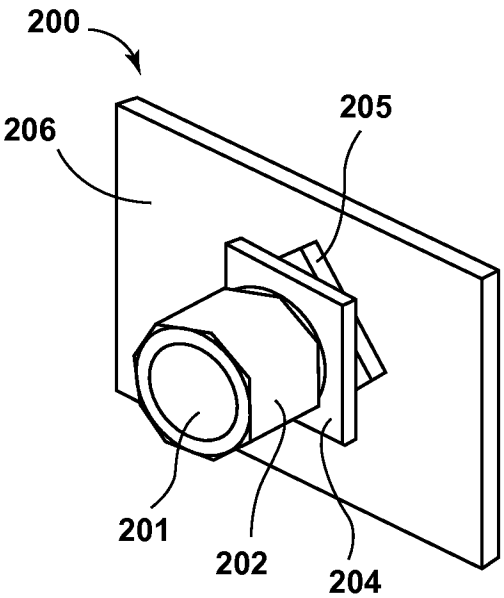
Figure 2A:
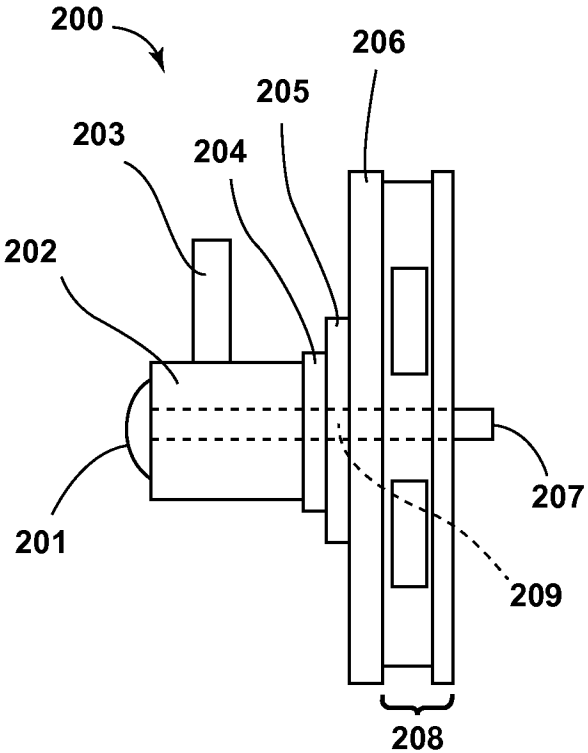
Figure 3:
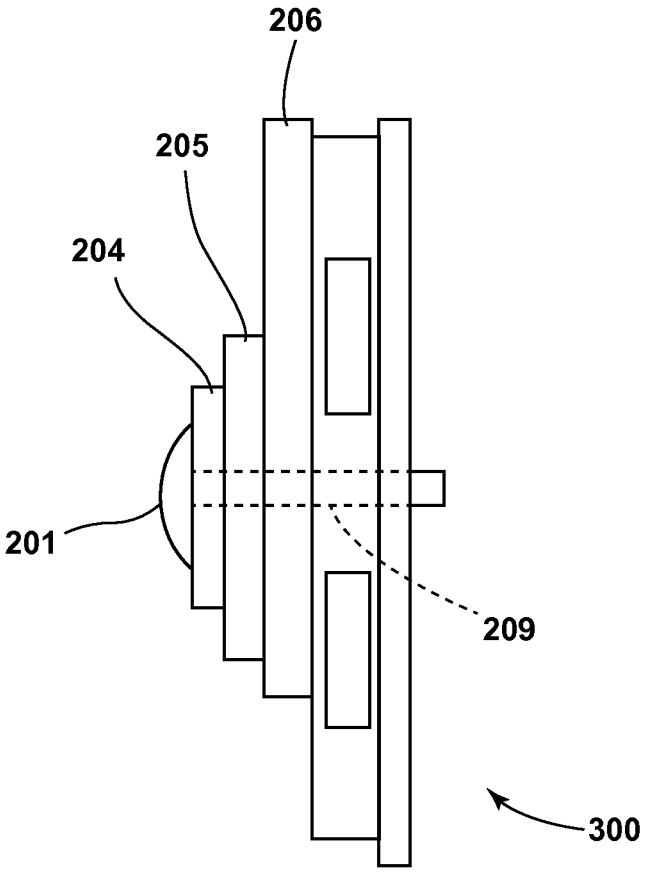
FIGS. 3, 4A-B and 5 illustrate alternative example liner pass throughs.
Figure 4A:
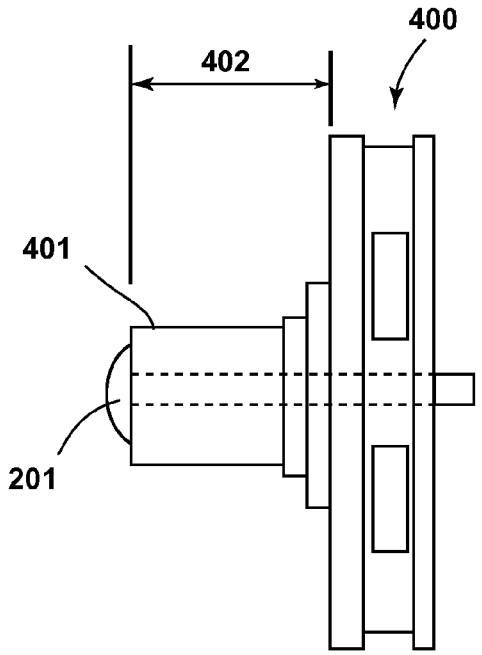
Figure 4B:
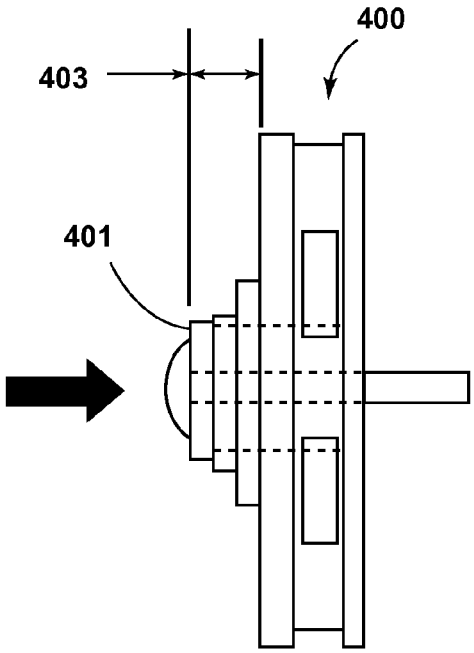

FIG. 1 is an isometric perspective view of an example refrigerator 100 in which the passing of electrical signals through a refrigerator liner according to this disclosure may be implemented. The example refrigerator 100 includes a main cabinet 1 partitioned into a refrigerating compartment 2 and a freezing compartment 3 having respective front openings. The compartments 2, 3 are defined by a refrigerator liner 800 (see FIG. 8A-C). In the example of FIG. 1, the liner pass through 200 of FIGS. 2A-C is used to pass electrical signals through the refrigerator line 800 to moveable members positioned within the refrigerator 100. Additionally or alternatively, the example liner pass throughs of FIGS. 3, 4A-B, 5, 6A-B, 7A-D, and 12 may be used to pass electrical signals through the refrigerator liner 800. A refrigerating compartment door 4 and a freezing compartment door 5 respectively open and close the respective front openings of the refrigerating and freezing compartments 2, 3.

In the front of the example freezing compartment door 5 is formed a dispenser 6 having a dispensing part 7 that is typically recessed to accommodate a container to receive, for example, water and ice, for consumption by a person or animal, for example. The dispensing part 7 includes a discharging lever 8 to be operated for obtaining, for example, ice and water. The discharging lever 8 is, for example, rotatable forward and backward inside the dispensing part 7. Alternatively, a user interface 9 may be used to obtain ice and water. The user interface 9 may, additionally or alternatively, be used to implement any number and/or type(s) of additional or alternative functions. An example user interface 9 includes a capacitive touch area, although other types of user interface elements may of course be used. While in the example of FIG. 1 the dispenser 6 is formed in the freezing compartment door 5, the dispenser 6 may be located elsewhere. For example, in the refrigerator compartment door 4, inside the refrigerator compartment 2, inside the freezing compartment 3, etc. A refrigerator implementing the liner pass throughs disclosed herein need not have a dispenser or user interface.

FIGS. 2A-2C illustrate an example liner pass through 200 that may be used to, for example, pass electrical signals through a liner such as the liner 800 of FIGS. 1 and 8A-C. The example liner pass through 200 has an exposed electrically conductive contact 201 that is presented or exposed within an interior compartment of the refrigerator 100 (e.g., within the compartment 2 or within the compartment 3). In the example of FIGS. 2A-2C, the contact 201 is implemented in connection with a member 202 that extends into the interior compartment. In some examples, the extending member 202 is substantially cylindrical. However, other shapes, such as square or rectangular, are contemplated. In some examples, the extending member 202 is used to provide mechanical support to a moveable member 203, such as a shelf, drawer, bin, basket, etc. The length of the extending member 202 may depend on dimensions and/or dimensional variations of the interior compartment and the moveable member 203, the specifics of which are not germane to this disclosure. In other examples, such as the alternative example liner pass through 300 of FIG. 3, the extending member 202 is omitted when, for example, mechanical support is not needed, desired or required. For example, when mechanical support is provided by other means, such as ribs, protrusions, brackets, etc. Because the profile of the liner pass through 300 is reduced because the member 202 is emitted, aesthetic appearance is enhanced. Furthermore, rather than being stationary, the member 202 of FIGS. 2A-C may instead be a retractable member 401, as shown in the alternative example liner pass through 400 of FIGS. 4A-B, to reduce the distance the retractable member 401 extends from a distance 402 to a distance 403 when not in use. When retracted, the profile of the liner pass through 400 is reduced enhancing aesthetic appearance.

The contact 201 may be substantially stationary relative to the extending member 202, may be compressible, may move relative to the extending member 202 in response to, for example, a spring 501 (FIG. 5), may be a retractable contact 601 (FIGS. 6A-B), etc. The retractable examples of FIGS. 4A, B and 6A, B may be implemented, by way of example, by addition of a mechanism to latch, respectively, the member 202 and the contact 201 when these are manually pushed toward the liner 800. After latching, the member 202 and the contact 201 may be unlatched and extended into the interior space by again applying pressure to the mechanism. In some examples, both the member 202 and the contact 201 are retractable.

Figure 7A:
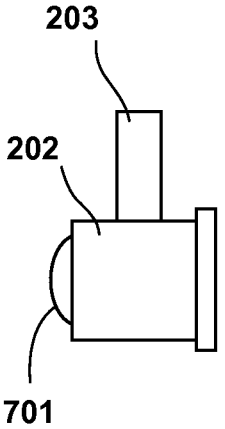
FIGS. 7A-D illustrate example contacts.
Figure 7B:
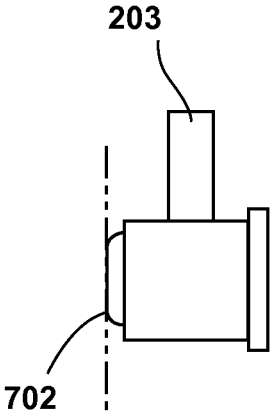
Figure 7C:
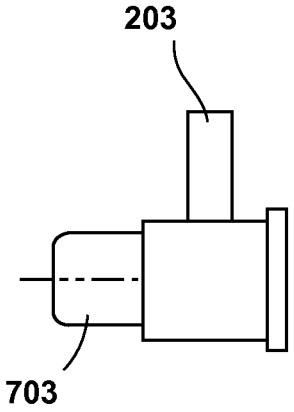
Figure 7D:
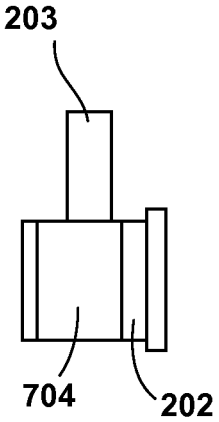

As shown in FIGS. 7A-7D, the contact 201 may have different shapes, such as, but not limited to a hemispherical contact 701 (FIG. 7A), a substantially flat contact 702 (FIG. 7B), an extending contact 703 (FIG. 7C), or a contact 704 formed on at least a portion of the extending member 202 (FIG. 7D), a point contact, a combination thereof, etc. In the example of FIG. 7C, electrical contact may be made along at least a portion of the length of the contact 703. In the example of FIG. 7D, the contact 704 encircles the member 202 in a ring-like or band-like manner, however, other shapes for the contact 704 are contemplated. In FIG. 7D, the extending member 202 in connection with the encircling contact 704 provide both mechanical support and electrical coupling for the moveable member 203. In some examples, there is an advantage to keeping the electrical coupling via the contact 201, 701-703 separate from the mechanical support provided by the member 202 as mechanical wear is separated from the wear (e.g., sliding wear) on the contact 201, 701-703 caused as the contact 201,701-703 slides into electrical coupling with the moveable member 203. However, it is contemplated that the example of FIG. 7D may have a lower cost in some examples, as the sleeve 704 can provide both electrical conduction and mechanical support. In addition to different shapes, the contact 201 may have different dimensions. In practical implementations, the shape and dimensions of the contact 201 will depend on or be selected based on design preferences and/or design particulars, the specifics of which are not germane to this disclosure.

Returning to FIGS. 2A-C, to allow the example liner pass through 200 to be assembled to the liner 800 of FIGS. 1 and 8A-C, the liner pass through 200 has three members 204, 205 and 206. In FIGS. 2A-2C, the member 205 is generally planar extending planarly from the member 202 forming, for example, flanges. A portion of each of the members 204, 206 (e.g., a planar surface, two or more points defining a plane, a seal, etc.) facing in the direction of the member 205 are generally planar. The members 204, 205 allow a portion of the liner pass through 200 to pass though an opening or hole 801 in the liner 800, and to assemble the liner pass through 200 to the liner 800. When assembled to the liner 800, the liner pass through 200 exposes the contact 201 within the interior compartment, and a second electrically conductive contact point 207 outside the liner 800 in a space between the liner 800 and the cabinet 1.

In the example of FIGS. 2A-C and 8A-C, the opening 801 and the members 204, 205 are square shaped, with the members 204, 205 having dimensions that substantially correspond to the opening 801. The example member 205 of FIGS. 2A-C is rotated at, for example, 45 degrees relative to the member 204, and has a thickness substantially corresponding to the thickness of the liner 800. The example member 206 of FIGS. 2A-C is shaped and dimensioned to not be able to pass through the opening 801. In some examples, the member 206 has a member 208, such as a rib-shaped member that can be grasped by, for example, fingers or a machine to facilitate assembly of the liner pass through 200 to the liner 800.

In some examples, such as a dishwasher or oven, it may be preferable to install the liner pass through 200 from inside the liner 800, with the shape and dimensions of the member 204 selected so the opening 801 is covered by the member 204 when the liner pass through 200 is assembled to the liner 800. In such examples, the member 204 may include a seal against water and/or heat disposed on the side of the member 204 facing the liner 800.

Figure 8A:
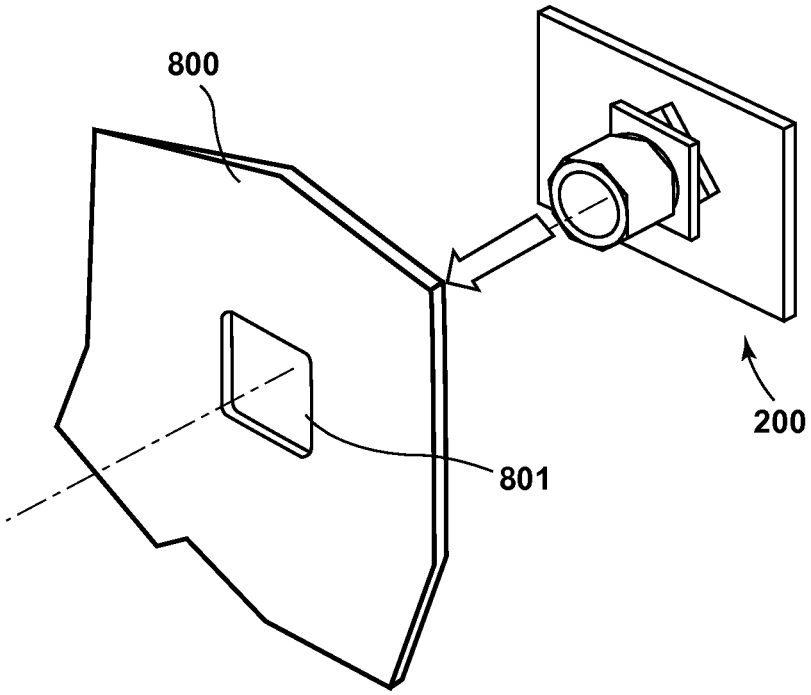
FIGS. 8A-C illustrate an example method of assembling the example liner pass through of FIGS. 2A-C to a refrigerator liner.
Figure 8B:
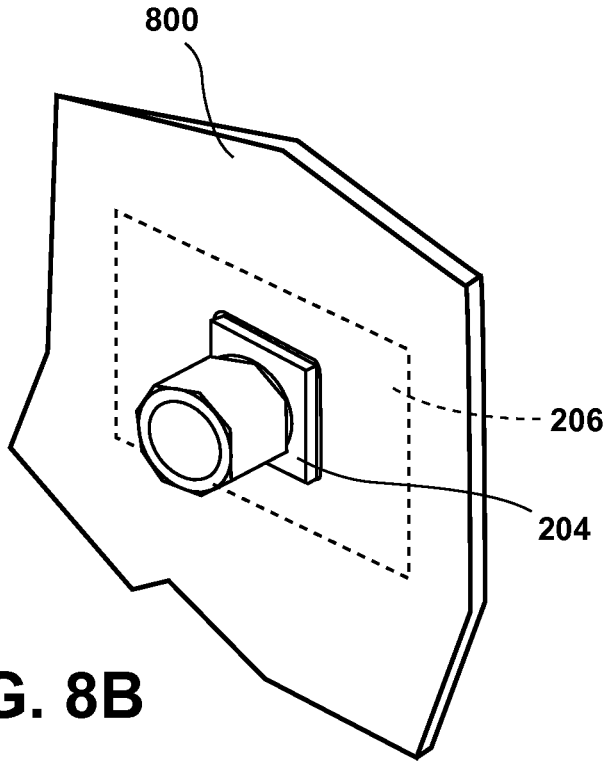
Figure 8C:
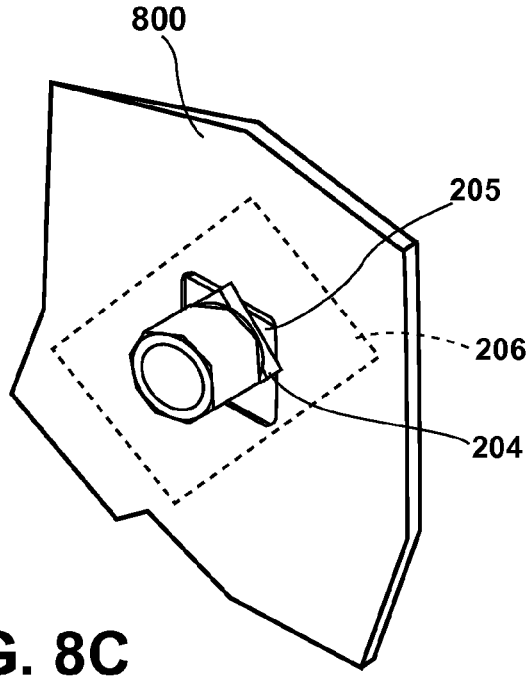

Turning to FIGS. 8A-C, the pass through element 200 is assembled to the liner 800 by passing the members 202 and 204 through the opening 801 so the member 204 is positioned in, engaged in, aligned with, etc. the opening 801 (FIGS. 8A-B). The pass through element 200 is then pressed toward the outside of the liner 800 and rotated by 45 degrees so the member 204 becomes internal to the liner 800 and rotated relative to the opening 801, and the member 205 becomes positioned in, engaged in, aligned with, etc. within the opening 801. As the rotation is performed, tapered transition edges located between the members 204, 205 create an axial pressure between the inner surface of the liner 800 and the member 204, and between the outer surface of the liner 800 and the member 206. That is, the members 204, 206 apply opposing forces to opposite sides of the liner 800. These forces hold the member 205 in the opening 801, thereby preventing further rotation, and pulls the member 206 against the outside surface of the liner 800 to form a seal that reduces the passage of, for example, air or foam through the opening 801.

While a square shaped is shown in FIGS. 2A-C and 8A-C, it should be understood that other shapes may be used, even though a square shape may be generally aesthetically preferable. Moreover, a liner pass through is envisioned that may be assembled from inside the liner 800 rather than from outside the liner, or from either sides. In general, the members 204-206 are shaped so the members 204, 206 each engage at least one boundary of the opening 801 when the liner pass through is positioned at a first rotational orientation, where at least one of the members 204, 206 is dimensioned to pass through the opening 801 when the liner pass through is positioned at a second rotational orientation, the member 205 dimensioned to fit within the opening 801 at the first rotational orientation and having a thickness normally corresponding to the liner 800, and the members 204, 206 apply opposing forces to opposite sides of the liner 800 when the member 205 is positioned in the opening 801. The members 204, 206 need not be planar as long as they are shaped to apply opposing forces when the liner pass through is assembled to the liner 800. Preferably at least one of the members 204, 206 is larger than the opening 801 in the first rotational orientation and forms a seal with the liner 800 when the liner pass through is assembled to the liner 800. While the opening 801 and the member 205 need not have the same shape and dimensions, preferably the opening 801 and the member 205 have corresponding features (e.g., corners or points) that prevent rotation of the liner pass through when the member 205 is positioned in the opening 801.

Returning to FIGS. 2A-C, to conduct or pass electrical signals between the interior contact 201 and the exterior contact point 207, the example liner pass through 200 includes an electrical conductor 209 that passes through the liner pass through 200 between the contact 201 and the contact point 207. The electrical conductor 209 need not pass through the member 208. The conductor 209 is electrically coupled to system wiring (i.e., to a wiring harness) within the space between the liner 800 and the cabinet 1 at or near the contact point 207. Typically, the system wiring is encompassed within a material, such as foam, insulation, etc., in that space. The example conductor 209 is cylindrical, however, other shapes are contemplated. The conductor 209 may be, for example, solid or stranded wire with or without insulation, or any other shape of electrically conductive material. In some examples, the members 202, 204, 205 and 206 are formed of an electrically insulating material, and are arranged closely to the conductor 209 to form a seal between them. This close arrangement may be achieved by assembly methods such as insert molding or press-fit assembly. The sealing acts to prevent passage of air and foam insulation through the liner pass through 200. In some examples, the conductor 209 may be formed integrally with the system wiring. Additionally or alternatively, the contact 201 and conductor 209 may be formed of a single piece of conductive metal and insert molded in the structure of the liner pass through 200.

Wiring harnesses are often provided as a subassembly by a harness supplier to a refrigerator manufacturer. Thus, in some examples, the liner pass through 200 is electrically coupled to a system wiring harness when received by a refrigerator manufacturer. This harness is typically assembled to the refrigerator 100 in the space between liner 800 and the metal cabinet 1. This subassembly allows the liner pass through 200 to be installed into the square-shaped hole 801 in the liner 800, as described above, with electrical couplings already robustly made by the harness supplier, thus reducing the chance for errors in electrical couplings that may arise in a refrigerator manufacturing environment.

Figure 9:
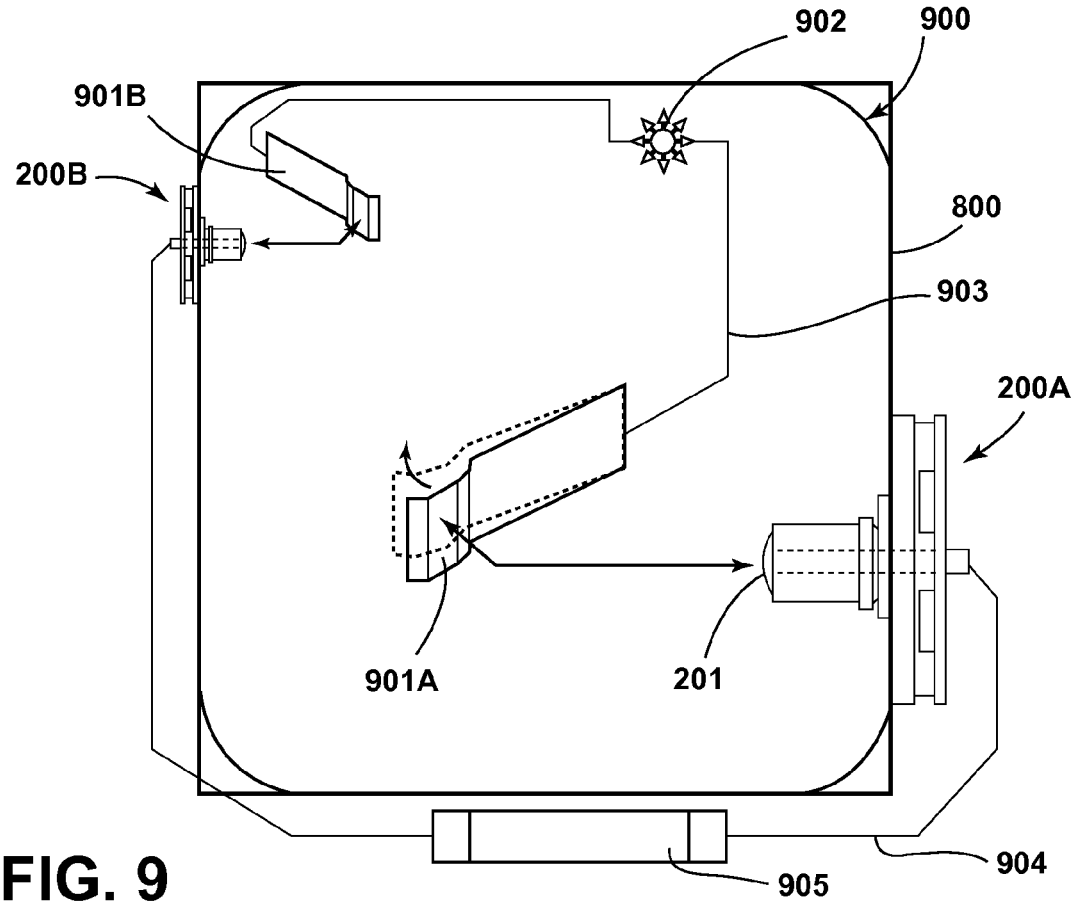
FIG. 9 is a schematic diagram of an example manner of implementing a moveable member in accordance with the teachings of this disclosure.
Figure 10A:
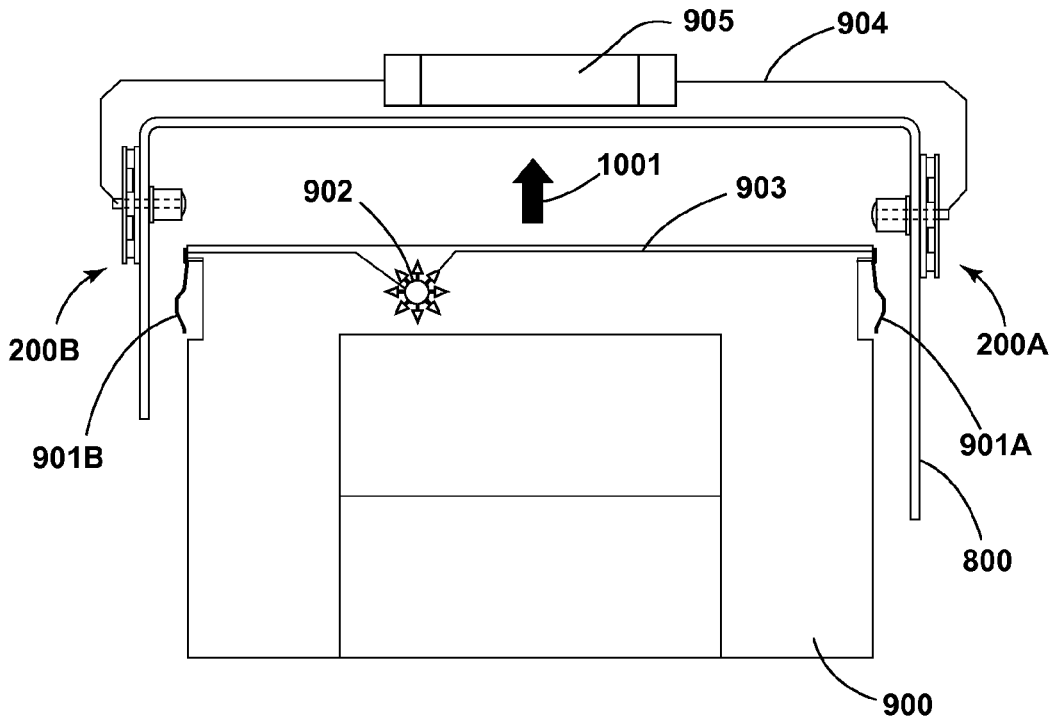
Figure 10B:
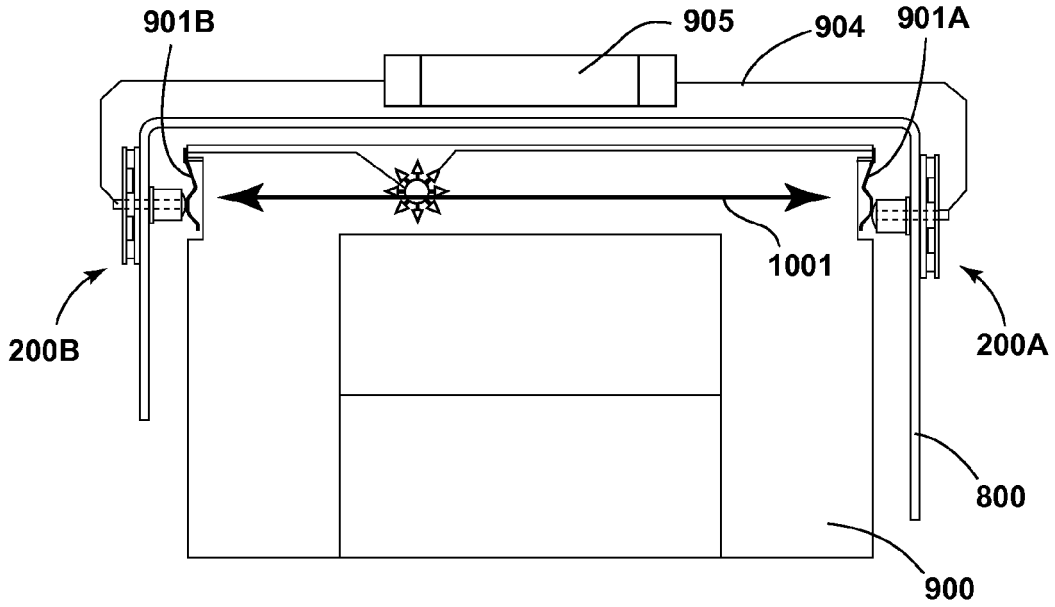

FIG. 9 illustrates an example manner of implementing the example moveable Member 203 of FIG. 2A. To conduct an electrical signal to a moveable member 900, the example moveable member 900 of FIG. 9 includes a spring-force electrically conductive contact 901A. As shown in FIG. 9, a liner pass through 200A is arranged to be in contact with the contact 901A when the moveable member 900 is at a pre-determined position relative to the liner pass through 200A. Example predetermined positions are when a shelf is fully positioned within the refrigerator 1, when a drawer is opened by a set amount, etc. When the liner pass through 200A is electrically coupled to the contact 901A, an electronic component 902 of the moveable member 900 becomes electrically coupled via a conductor 903 of the moveable member 900, the contact 901A, the liner pass through 200A, a conductor 904 outside the liner 800 (e.g., part of a system wiring harness) to, for example, a power supply 905. In the example of FIG. 9, the electronic component 902 is a lighting source that is coupled to the power supply 905 via the contact 901A to provide a voltage, and via another spring-force electrically conductive contact 901A and liner pass through 200B to provide ground. As shown in FIGS. 10A-B, the contacts 901A, B become electrically coupled to respective liner pass throughs 200A, B as the moveable member 900 slides in a direction 1001 from a partially inserted position shown in FIG. 10A into a fully inserted position shown in FIG. 10B.

When the liner pass throughs 200A, B are positioned substantially opposite each other (e.g., as shown in FIGS. 10A, B), they can apply opposing forces 1001 to the moveable member 900. Given this axial alignment and the opposing arrangement of spring forces that derives from the location of the corresponding spring-force contacts 901A, B that are also located on this axial line when the shelf is at the pre-determined position, and given that any pair of the contacts 901A, B will provide approximately equal forces per unit of distance deflected (i.e., have nearly equivalent spring constants) then the opposing spring-force contacts 901A, 901B will act to center the moveable member 900 left-to-right within the interior compartment. This provides an aesthetic benefit as the moveable member 900 tends to self center itself left-to-right when installed in the interior compartment.

An advantage is obtained as the spring-force contacts 901A, B deflect and rub across the surface of the contact 201 of the liner pass throughs 200A, B during movement in and out of electrical coupling. This relative rubbing action of mating electrical contact surfaces acts to break thru any surface oxides, corrosion, or build up of contaminants that could prevent the completion of electric circuits.

Figure 5:
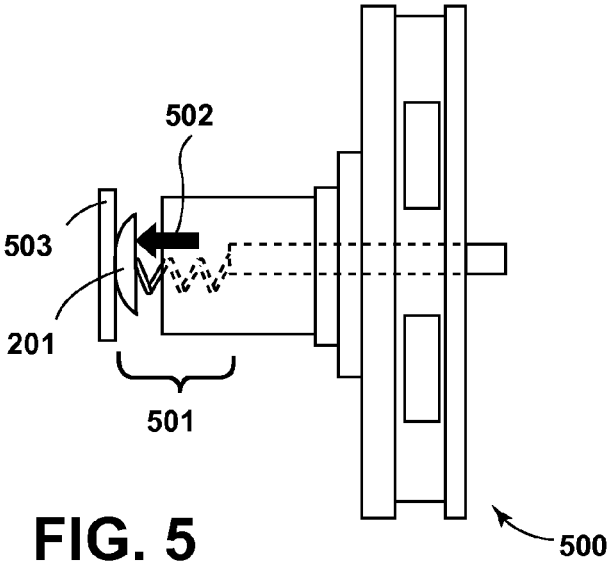
Figure 6A:
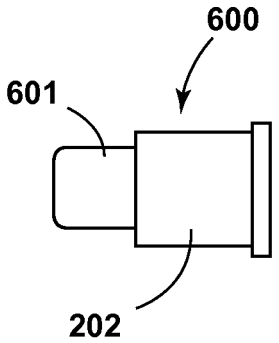
FIGS. 6A-B illustrate an example retractable contact.
Figure 6B:
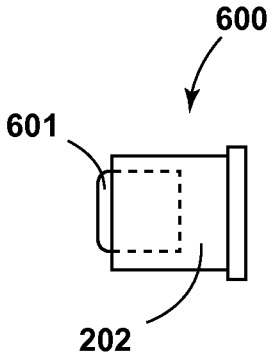
Figure 11:
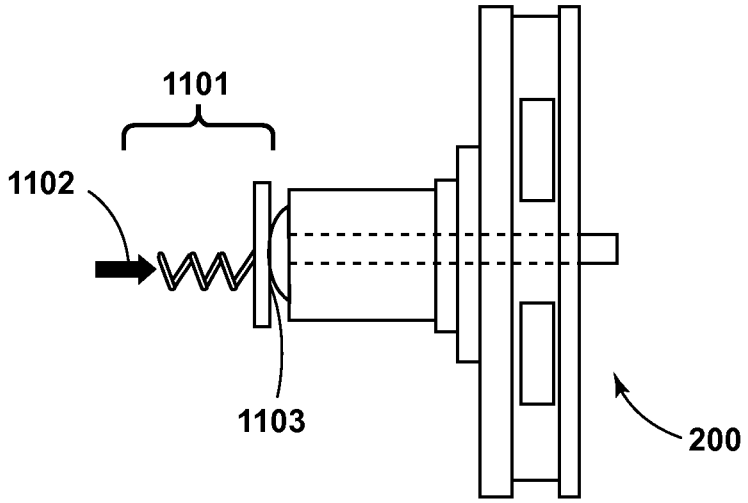
FIGS. 11 illustrates an alternative electrical coupling of a liner pass through to a refrigerator shelf.

Any spring elements may be used to achieve the force and desired behaviors described above, examples of which include leaf springs, compression springs, extension springs, elastic material elements, etc. It is understood that the embodiment disclosed herein that utilize a leaf spring contact have an advantage by providing a spring force and a relatively large surface contact area. Moreover, leaf springs reduce the potential for contacts catching on each other as they come into electrical contact. Additionally or alternatively to a leaf spring on the moveable member 900, the liner pass through 200 (e.g., within the member 202) may include a spring-force member 501 that applies a force 502 to the contact 201 (FIG. 5). Example spring-force members are compression springs, extension springs, and elastic elements. In FIG. 5, the spring-force member 501 works to move the contact pad 201 against a more stationary style of contact 503 that is a part of a moveable member. This spring-force member 501 may be electrically conductive to complete the electrical circuit within the line pass through 500. Such spring-force members 1101 may also be used instead of or in additional to the leaf spring 901A, B to provide a biasing force 1102 to an electrically conductive contact 1103 (FIG. 11).

Figure 12:
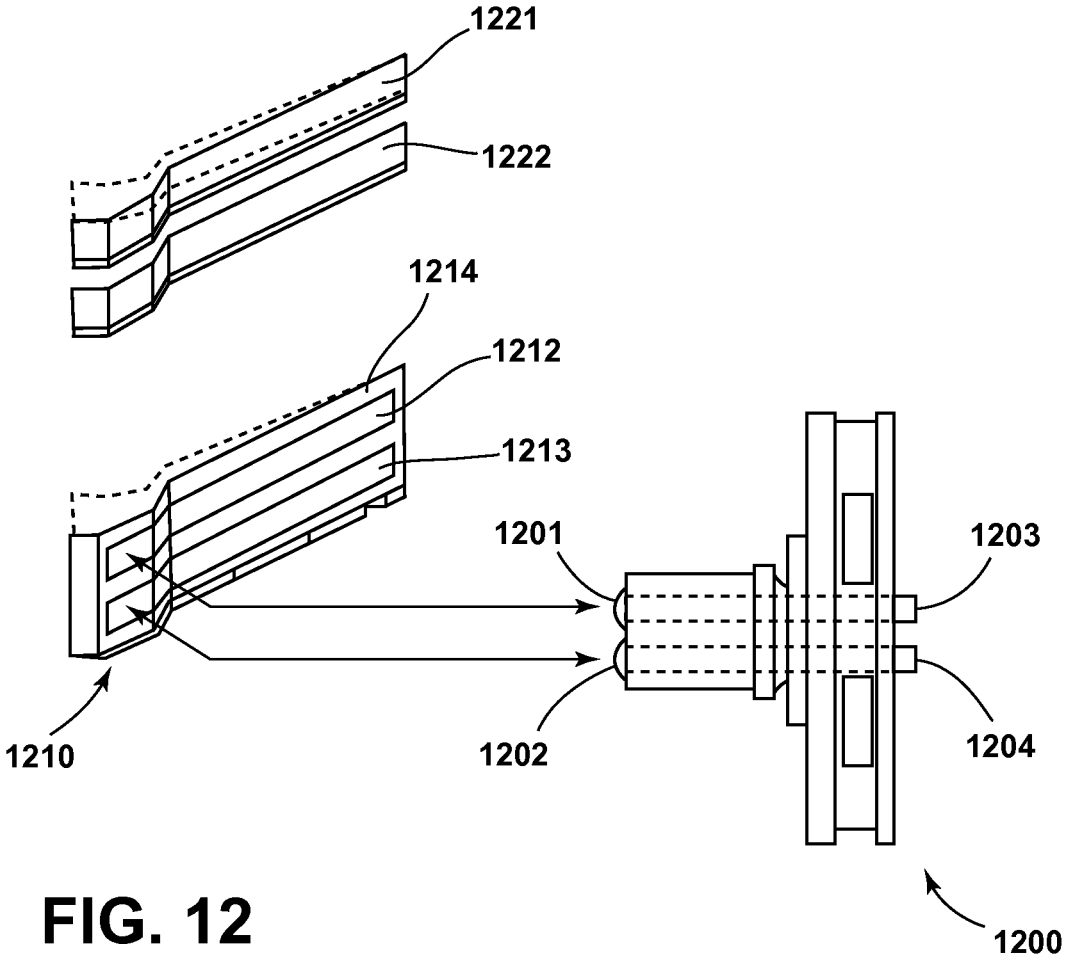
FIG. 12 illustrates yet another example liner pass through that conducts two electrical signals.

Turning to FIG. 12, a liner pass through 1200 may be used to conduct more than one electrical signal. In the example of FIG. 12, the liner pass through 1200 includes two electrically conductive contacts 1201 and 1202, which are electrically coupled to respective conductors 1203 and 1204. The contacts 1201, 1202 may be electrically coupled to a single leaf spring 1210 on a moveable member. The leaf spring 1210 having respective electrically conductive contacts 1211, 1212 with an intervening electrically insulating material 1214. Alternatively, a moveable member may have two separate respective leaf springs 1221, 1222 for respective ones of the contacts 1201, 1022. Any or all of the alternatives discussed above may be used in connection with a liner pass through 1200 have more than one electrical contact.

Any number and/or type(s) of liner pass throughs may be associated with a particular moveable member. For example, a first liner pass through may be associated with a first position of a moveable member (e.g., drawer fully closed) and a second liner pass through associated with a second position (e.g., drawer opened). Further, a moveable member may implement an elongated electrically conductive contact to enable an electrical signal to be conducted for a range of positions. Moreover, the liner pass throughs disclosed herein may be assembled to any number and/or place(s) locations including, but not limited to, side walls, back walls, on drawer mounting brackets, etc.

Any terms such as, but not limited to, approximately, substantially, generally, etc. used herein to indicate that a precise value, structure, feature, etc. is not required, need not be specified, etc. For example, a first value being approximately a second value means that from a practical implementation perspective they can be considered as if equal, a generally planar member will be understood to have manufacturing variability, etc. As used herein, such terms will have ready and instant meaning to one of ordinary skill in the art. Further, it will also be understood that practical devices implemented in accordance with this disclosure may have tolerances in their dimensions. However, such tolerances do not impact the applicability of the claims of this patent. Further still, unless expressly indicated as critical, any dimension or size disclosed herein is to not be considered as critical. Moreover, it should be understood that, at least, use of shapes different from those described herein fairly fall within the scope of the claims of this patent.

In this specification and the appended claims, the singular forms "a," an and the do not exclude the plural reference unless the context clearly dictates otherwise. Further, conjunctions such as "and," "or," and "and/or" used in this specification and the appended claims are inclusive unless the context clearly dictates otherwise. For example, "A and/or B" includes A alone, B alone, and A with B; "A or B" includes A with B, and "A and B" includes A alone, and B alone, Further still, connecting lines, or connectors shown in the various figures presented are intended to represent exemple functional relationships and/or physical or logical couplings between the various elements. It should be noted that many alternative or additional functional relationships, physical connections or logical connections may be present in a practical device. Moreover, no item or component is essential to the practice of the embodiments disclosed herein unless the element is specifically described as "essential" or "critical".

Although certain examples have been described herein, the scope of coverage of this patent is not limited thereto. On the contrary, this patent covers all methods, apparatus and articles of manufacture fairly falling within the scope of the claims of this patent.

What is claimed is:

1. An apparatus to pass an electrical signal within a refrigerator having an external cabinet, a liner at least partially defining an interior compartment within the cabinet and having an opening defined therethrough, and a moveable member within the compartment, the apparatus comprising:

first and second members not passable through the opening when the apparatus is positioned at a first rotational orientation, where at least one of the first and second members is passable through the opening when the apparatus is positioned at a second rotational orientation;

a planar third member between the first and second members, and dimensioned and shaped corresponding to the opening and fitting in the opening when the apparatus is positioned at the first rotational orientation;

an electrically conductive contact disposed together with the first member or a fourth member extending inward from the first member to conduct the electrical signal to the moveable member when the moveable member is at a predetermined position relative to the apparatus;

a spring member disposed to bias the contact into electrical coupling with the moveable member; and an electrical conductor electrically coupled to the contact and passing through the first, second and third members to the exterior of the liner to conduct the electrical signal from the exterior of the liner to the contact.

2. An apparatus as defined in claim 1, wherein the contact is retractable.

3. An apparatus as defined in claim 1, wherein the contact comprises at least one of a hemispherical contact, a flat contact, an extending contact, a retractable contact, a covering, a band, encompassing, or encircling.

4. An apparatus as defined in claim 1, wherein at least one of the first and second members is configured to form a seal with the liner when the apparatus is assembled to the refrigerator.

5. An apparatus as defined in claim 1, further comprising the fourth member extending inward from the first member, wherein the electrically conductive contact is at least one of at an end of the fourth member distal from the first member, extending from the end of the fourth member, or on a surface of the fourth member.

6. An apparatus as defined in claim 5, wherein the fourth member is retractable.

7. A refrigerator comprising:

a cabinet;

a liner at least partially defining an interior compartment within the cabinet;

a liner pass through partially extended through an opening in the liner and assembled to the liner, the liner pass through including a first electrically conductive contact within the compartment and a second electrically conductive contact outside the compartment;

a selectively moveable member having an electronic component, and a third electrically conductive contact to electrically couple the electronic component to the first contact;

a spring member to bias the first and third contacts into electrical coupling when the moveable member is at a predetermined position; and wherein the first contact is retractable.

8. A refrigerator as defined in claim 7, wherein the spring member is at least one of a spring or a leaf spring.

9. A refrigerator as defined in claim 7, wherein the liner pass through has an electrical conductor passing at least partially through the liner pass through that electrically couples the first and second contacts, and wherein the refrigerator further comprises another electrical conductor within the space and electrically coupled to the second contact, and a material substantially filling the space and encompassing the another conductor.

10. A refrigerator as defined in claim 7, further comprising:

another liner pass through assembled to the liner substantially opposite the liner pass through; and another spring member to bias the moveable member and the another liner pass through into electrical coupling, wherein the spring members apply a centering force to the moveable member when the moveable member is at the predetermined position.

11. A refrigerator as defined in claim 7, wherein the first and third contacts are brought into slidable contact as the moveable member moves toward the predetermined position.

12. A refrigerator as defined in claim 7, wherein the first contact comprises at least one of a hemispherical contact, a flat contact, an extending contact, a retractable contact, a covering, a band, encompassing, or encircling.

13. A refrigerator as defined in claim 7, wherein the liner pass through has a fourth electrically conductive contact within the interior compartment, wherein the moveable member has a fifth electrically conductive contact to electrically couple at least one of the electronic component or another electronic component to the fourth contact when the moveable member is at the predetermined position.

14. A refrigerator as defined in claim 13, wherein the third and fifth contacts comprise at least one of respective different contacts on a single leaf spring, or respective different leaf springs.

15. A refrigerator as defined in claim 7, wherein the liner pass through comprises:

first and second members not passable through the opening in a first rotational orientation, at least one of the first and second members passable through the opening in a second rotational orientation; and a planar third member between the first and second members, and dimensioned and shaped corresponding to the opening and fitting into the opening at the first rotational orientation;

wherein, when the liner pass through is assembled to the liner, the planar third member is engaged within the opening , and the first and second members are rotationally oriented to not pass through the opening and to apply forces to respective opposite sides of the liner.

16. A refrigerator as defined in claim 15, wherein the forces applied to opposite sides of the liner form a seal between at least one of the first and second members, and the third member prevents rotation of the liner pass through when positioned in the opening.

17. A refrigerator as defined in claim 7, wherein the liner pass through further includes a member extending inward to mechanically support the moveable member, and the first contact is at least one of at the end of the extending member distal from the liner or disposed on a surface of the extending member.

18. A refrigerator as defined in claim 17, wherein the spring member is disposed within the extending member.

19. A refrigerator as defined in claim 17, wherein the extending member is retractable.

20. A method of manufacturing a refrigerator having an external cabinet, a liner at least partially defining an interior compartment within the cabinet and having an opening defined therethrough, and a moveable member within the compartment, the method comprising:

providing an apparatus as defined in claim 1 having the conductor electrically coupled to a second electrical conductor;

positioning the apparatus in the second rotational orientation;

inserting one of the at least one of the first and second members dimensioned to pass through the opening when the apparatus is positioned at the second rotational orientation into the opening;

pressing and rotating the apparatus to the first rotational orientation to engage the third member in the opening, and to rotationally orient the first and second members to prevent their passage through the opening and to apply forces to respective opposite sides of the liner;

positioning the second conductor within a space at least partially defined by the liner and the cabinet; and placing a material between the liner and the cabinet that encompasses the another conductor.

* * * * *